US007578661B2

(12) United States Patent
Koeneman

(10) Patent No.: US 7,578,661 B2
(45) **Date of Patent: *Aug. 25, 2009**

(54) EMBEDDED FLUID PUMP USING A HOMOPOLAR MOTOR

(75) Inventor: Paul B. Koeneman, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 313 days.

This patent is subject to a terminal disclaimer.

(21) Appl. No.: 10/942,539

(22) Filed: Sep. 16, 2004

(65) Prior Publication Data

US 2006/0057004 A1 Mar. 16, 2006

(51) Int. Cl.
*F04B 35/04* (2006.01)

(52) U.S. Cl. ..... 417/423.7; 417/423.12

(58) Field of Classification Search ..... 417/423.7, 417/423.12, 53; 361/688, 695; 310/268
See application file for complete search history.

(56) References Cited

U.S. PATENT DOCUMENTS 2,914,688 A * 11/1959 Matthews ..... 310/178
3,090,875 A 5/1963 Harkness
3,205,384 A 9/1965 Sears
3,217,199 A 11/1965 Musset
3,548,231 A 12/1970 MacNab
3,678,306 A 7/1972 Garnier et al.
3,681,633 A 8/1972 McNab et al.
3,705,775 A 12/1972 Rioux et al.
3,796,900 A 3/1974 McNab et al.
5,097,170 A * 3/1992 Baines ..... 310/268
5,281,364 A 1/1994 Stirling et al.
5,481,149 A 1/1996 Kambe et al.
5,694,196 A 12/1997 Hirai et al.
5,783,879 A 7/1998 Furlani et al.
5,821,659 A 10/1998 Smith
5,822,839 A 10/1998 Ghosh et al.
5,932,940 A 8/1999 Epstein et al.
6,086,243 A 7/2000 Paul et al.
6,158,984 A 12/2000 Cao et al.
6,493,224 B1 12/2002 Mottahed
6,530,217 B1 3/2003 Yokota et al.
6,590,370 B1 7/2003 Leach
6,628,522 B2 9/2003 Trautman et al.
6,655,923 B1 12/2003 Lisec et al.

(Continued)

OTHER PUBLICATIONS

U.S. Appl. No. 10/919,464, filed Aug. 16, 2004, Koeneman.

*Primary Examiner*—Michael Cuff
*Assistant Examiner*—Vikansha S Dwivedi
(74) *Attorney, Agent, or Firm*—Darby & Darby PC; Robert J. Sacco

(57) ABSTRACT

A fluid pump (100) having a homopolar motor (110). The homopolar motor includes a rotatable disk (115) defining at least one impeller (120). The impeller can include an orifice within the rotatable disk. The rotatable disk can be at least partially disposed within a cavity (145) defined in the substrate (105), such as a ceramic substrate, a liquid crystal polymer substrate, or a semiconductor substrate. A closed loop control circuit (335) can be included to control the rotational speed of the rotatable disk. For example, the control circuit can control a voltage source or a current source that applies voltage across the rotatable disk. The control circuit also can control a strength of a magnet (310) that applies a magnetic field (305) substantially aligned with an axis or rotation (155) of the rotatable disk.

11 Claims, 9 Drawing Sheets

U.S. PATENT DOCUMENTS

| | | | | |
|---|---|---|---|---|
| 6,666,658 | B2 | 12/2003 | Takeuchi et al. | |
| 6,756,708 | B2 | 6/2004 | Koeneman | |
| 6,770,997 | B2 | 8/2004 | Koeneman | |
| 6,808,371 | B2 * | 10/2004 | Niwatsukino et al. | 417/353 |
| 7,093,818 | B2 | 8/2006 | Koeneman | |
| 7,371,052 | B2 | 5/2008 | Koeneman | |
| 2003/0134172 | A1 * | 7/2003 | Grande et al. | 429/34 |
| 2004/0012654 | A1 | 1/2004 | Takeuchi et al. | |
| 2004/0041488 | A1 | 3/2004 | Koeneman | |
| 2004/0046473 | A1 | 3/2004 | Koeneman | |
| 2004/0095031 | A1 | 5/2004 | Koeneman | |
| 2004/0126254 | A1 | 7/2004 | Chen et al. | |
| 2005/0194941 | A1 | 9/2005 | Tupper et al. | |
| 2006/0027777 | A1 * | 2/2006 | Koeneman | 251/205 |
| 2006/0057004 | A1 | 3/2006 | Koeneman | |
| 2008/0175733 | A1 | 7/2008 | Koeneman | |

* cited by examiner

EMBEDDED FLUID PUMP USING A HOMOPOLAR MOTOR

BACKGROUND OF THE INVENTION

1. Statement of the Technical Field

The inventive arrangements relate generally to the field of micro electromechanical system (MEMS) devices.

2. Description of the Related Art

Miniaturization of various devices that utilize fluidic systems has spurred a need for development of fluidic systems having very small components. These systems are commonly known as microfluidic systems. Microfluidic systems have the potential to play an increasingly important role in many developing technology areas. For example, there has been an increasing interest in recent years in the use of liquid fuels in microengines and in the use of fluid dielectrics in electronics systems:

Another technological field where micro-fluidic systems are likely to play an increasingly important role is fuel cells. Fuel cells generate electricity and heat by electrochemically combining a fuel and an oxidant, via an ion-conducting electrolyte. Some types of fuel cells produce waste water as a byproduct of the reaction. This waste water must be transported away from the reaction to be exhausted from the system by a fluid management sub-system.

Efforts are currently under way to create very small fuel cells, called microcells. It is anticipated that such microcells may eventually be adapted for use in many portable electronics applications. For example, such devices could be used for powering laptop computers and cell phones. Still, microcells present a number of design challenges that will need to be overcome before these devices can be practically implemented. For example, miniaturized electromechanical systems must be developed for controlling the fuel cell reaction, delivering fuel to the reactive components and disposing of water produced in the reaction. In this regard, innovations in fuel cell designs are beginning to look to silicon processing and other techniques from the fields of microelectronics and micro-systems engineering.

As with most other types of fluidic systems, microfluidic systems usually incorporate fluid pumps that are implemented as discrete components. Discrete components tend to be bulky, however, which oftentimes impedes miniaturization efforts. Moreover, such fluid pumps typically include pluralities of moving parts that must interoperate. The reliability of such devices, however, is generally inversely proportional to the number of moving parts since the moving parts tend to wear. Hence, an embedded fluid pump that can overcome the aforementioned limitations is needed for use in microfluidic systems.

SUMMARY OF THE INVENTION

The present invention relates to a fluid pump having a homopolar motor. The homopolar motor includes a rotatable disk defining at least one impeller. The impeller can include an orifice within the rotatable disk. The rotatable disk can be at least partially disposed within a cavity defined in a substrate, such as a ceramic substrate, a liquid crystal polymer substrate, or a semiconductor substrate.

The substrate can have a first fluid port defined therein. The first fluid port can be fluidically coupled to the rotatable disk such that a movement of the rotatable disk causes a fluid to flow through the first fluid port. The substrate can also have a second fluid port fluidically coupled to the rotatable disk such that a movement of the rotatable disk causes a fluid to flow from the first fluid port through the second fluid port. Movement of the rotatable disk causes fluid to flow in a direction that is substantially aligned with an axis of rotation of the rotatable disk or generally tangential to an outer circumference of the disk.

A closed loop control circuit can be included to control the rotational speed of the rotatable disk. For example, the control circuit can control a voltage source and a current source that applies voltage across the rotatable disk. The control circuit also can control a strength of a magnet that applies a magnetic field substantially aligned with an axis of rotation of the rotatable disk.

DETAILED DESCRIPTION OF THE PREFERRED EMBODIMENTS

The present invention relates to a fluid pump embedded within a substrate. Accordingly, the fluid pump can be manufactured as a micro electromechanical system (MEMS) device. The fluid pump can be a stand alone device or can be advantageously integrated within a larger system. Examples of such larger systems can include electronic devices, fuel cells, sensor systems, fluidic systems, or any other device having a substrate. Importantly, the invention is not limited to any particular type of device.

In one arrangement, the fluid pump can be embedded within a microfluidic system. In another arrangement, the fluid pump can be embedded within a substrate proximate to one or more thermal generating devices. In such an instance, the fluid pump can be used to blow a fluid, such as air, on the thermal generating devices, thereby improving device heat dissipation. Accordingly, the fluid pump can be used as a low profile cooling solution in place of conventional cooling fans that are oftentimes used within electronics systems.

Figure 1:
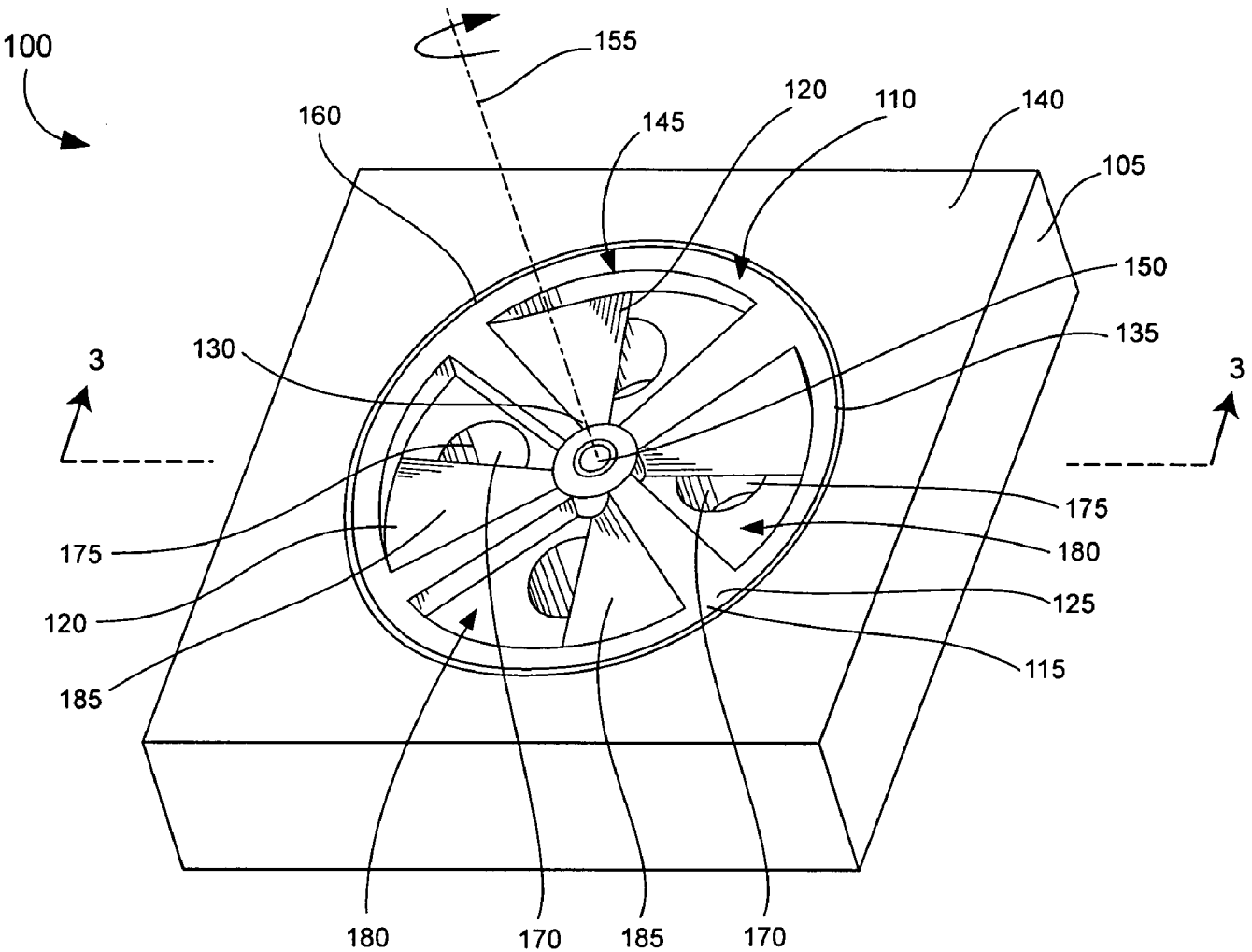
FIG. 1 is a perspective view of a fluid pump that is useful for understanding the present invention.

Referring to FIG. 1, a perspective view of a fluid pump 100 in accordance with the present invention is shown. The fluid pump 100 can be manufactured on a substrate 105, which can be any of a variety of substrates. For example, the fluid pump 100 can be manufactured on a substrate made of liquid crystal polymer (LCP), ceramic, silicon, gallium arsenide, gallium nitride, germanium or indium phosphide. Still, the invention is not so limited and any substrate material suitable for a micro-electromechanical manufacturing process can be used.

The fluid pump 100 can include a microelectromechanical homopolar motor (homopolar motor) 110 having a conductive rotatable disk (disk) 115. One or more impellers 120 can be defined by the disk 115. The impellers 120 can be any structures defined by the disk 115 that are suitable for displacing fluids. For example, the impellers 120 can be defined by openings or orifices 180 within the disk 115 and/or surface contours 185 of the rotatable disk 115. The openings or orifices 180 and surface contours 185 can cause fluid to be displaced as the disk 115 rotates. In another arrangement the impellers 120 can be blades disposed on the rotatable disk 115 proximate to the orifices 180. For instance, the blades can extend upwards from an upper surface 125 of the disk 115. The blades can be integrally formed on the disk 115 or attached to the disk via glue, fasteners, a weld, or any other suitable attachment means.

The impellers 120 can extend from a central portion 130 of the disk 115 to an outer peripheral region 135 of the disk 115. In one arrangement the impellers 120 can extend radially from the central portion 130 of the disk 115 in a linear fashion. However, the invention is not so limited. For example, the impellers 120 can be curved, angled, or have any other desired shape. Moreover, impellers having complex mechanical configurations can be provided. For instance, the impellers 120 can include a plurality of curved and/or angled portions configured to optimize fluid displacement in the application for which the fluid pump 100 will be used.

The disk 115 can be positioned proximate to a surface 140 of the substrate 105, for example within a cavity 145 defined within a substrate 105. Importantly, the cavity 145 can have a shape that is substantially circular, square, rectangular, or any other desired shape. Nevertheless, it should be noted that a cavity is not required to practice the present invention. For instance, the disk 115 can be disposed above the surface 140 of the substrate 105.

In one arrangement, the disk 115 can be provided with an axle 150 to facilitate rotation about the central axis 155 of the disk 115 and maintain the disk 115 in the proper operating position. Nevertheless, other arrangements can be provided as well. For example, in another arrangement the cavity 145 can be structured with a low friction peripheral surface 160 that maintains the disk 115 within the cavity 145. In yet another arrangement, a bore can be provided at the central axis 155 of the disk 115. The bore can fit over a cylindrical structure, such as a bearing, to maintain the operating position of the disk 115.

In operation, rotation of the disk 115 rotates the impellers 120 about the central axis 155, moving the impellers 120 through a fluid medium. Accordingly, the impellers 120 can cause fluid to be displaced.

Fluid channels 170 can be formed in the substrate 105 such that fluid ports 175 are formed below the disk 115. In one arrangement, the fluid channels 170 can extend linearly through the substrate 105 to draw fluid from below the substrate 105 or push fluid through the substrate 105. For example, air can be pulled through the fluid ports 175 and blown onto devices which require air cooling. In this arrangement, the fluid flow can be substantially aligned with the central axis 155. However, the invention is not so limited. For example, a fluid flow structure can be provided above the disk 115 to direct the fluid flow into any desired direction. The fluid flow structure can include one or more veins, tubes, or any other structure suitable for directing fluid flow.

Other fluid channel configurations also can be provided. For instance, the fluid channels 170 can be formed to fluidically couple the disk 115 to a fluid reservoir contained elsewhere in a system. Movement of the impellers 120 thus can pump fluid into, or out from, the channels 170 via the fluid ports 175. Such an arrangement can be advantageous for use in pumping fluids within microfluidic systems. Additional ports also can be provided. For instance, movement of the impellers 120 can displace fluid from a first port through a second port.

Figure 2:
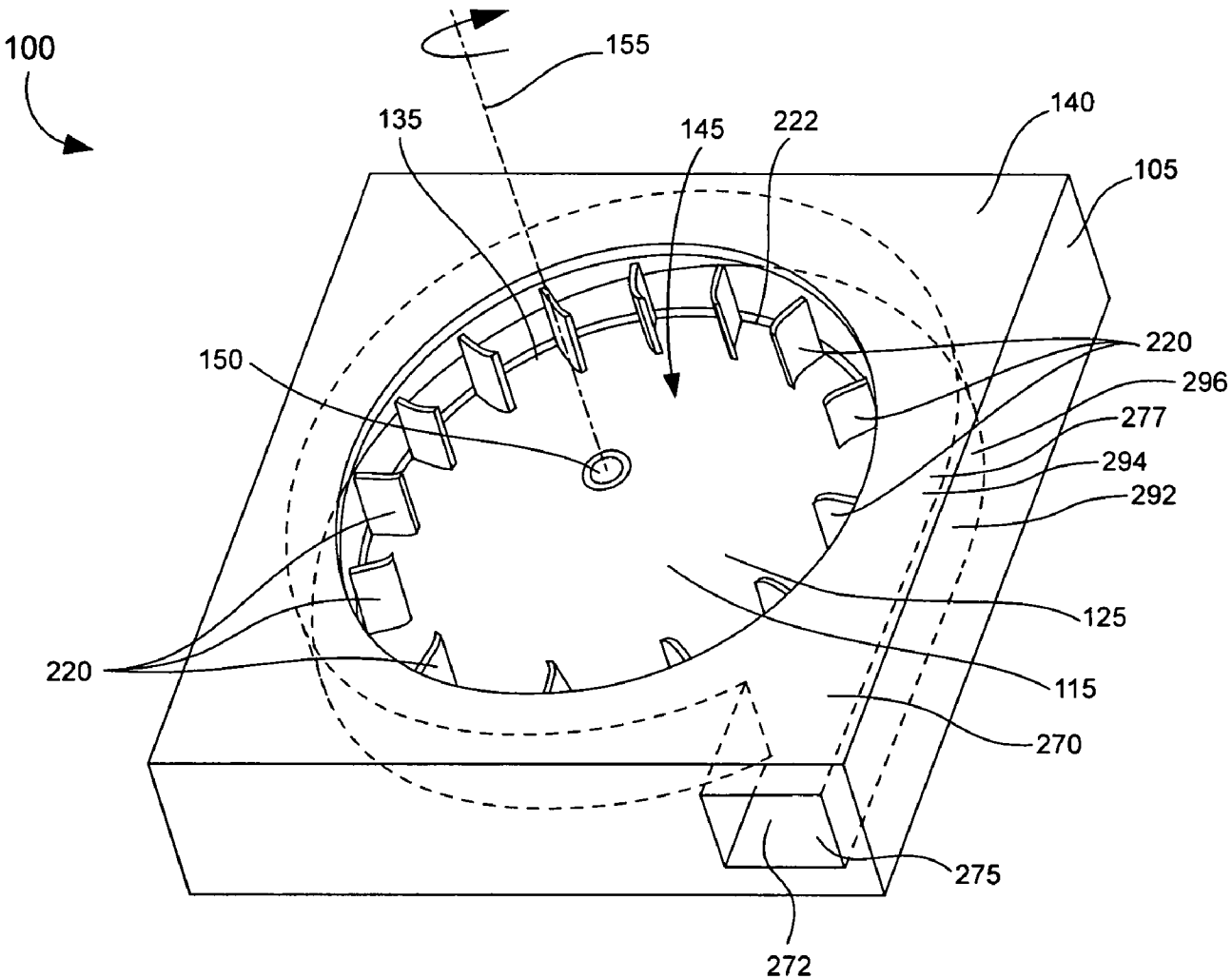
FIG. 2 is a perspective view of another fluid pump that is useful for understanding the present invention.

In another embodiment, the fluid pump 100 can be embedded within the substrate 105 as shown in FIG. 2. In this arrangement the impellers can be structured to direct fluid flow circumferentially or in a direction generally tangential to an outer circumference 222 of the disk 115. For instance, the impellers can be fluid flow blades (blades) 220 positioned around the outer peripheral region 135 of the disk 115 and extending upward from the upper surface 125 of the disk 115. The blades 220 can be structured to cause fluid to flow through a fluid channel 270 defined within the substrate 105 when the disk 115 is rotated about the central axis 155. The blades 220 can be integrally formed on the disk 115 or attached to the disk via glue, fasteners, a weld, or any other suitable attachment means. The blades 220 can be curved, angled, or have any other desired shape. Moreover, blades 220 having complex mechanical configurations can be provided. For instance, the blades 220 can include a plurality of curved and/or angled portions configured to optimize fluid flow in the application for which the fluid pump 100 will be used.

The fluid channel 270 can include a first portion 272 defining a fluid port 275 and a second portion 277 extending around the outer peripheral region 135 of the disk 115. The second portion 277 can be bounded on a plurality of sides by the substrate 105. For instance, the fluid channel can be defined by a lower channel surface 292, an upper channel surface 294 and radial channel surface 296. The second portion 277 can be open to the cavity 145 so as to facilitate fluid flow between the cavity 145 and the second portion 277 and, in consequence, the fluid port 275. Thus, in the case that the disk 115 is rotated clockwise, fluid can flow from the cavity 145 through the fluid port 275. In the case that the disk 115 is rotated counterclockwise, fluid can flow from the fluid port 275, into the cavity 145 and away from the disk 115, generally in an upwards direction.

Figure 3:
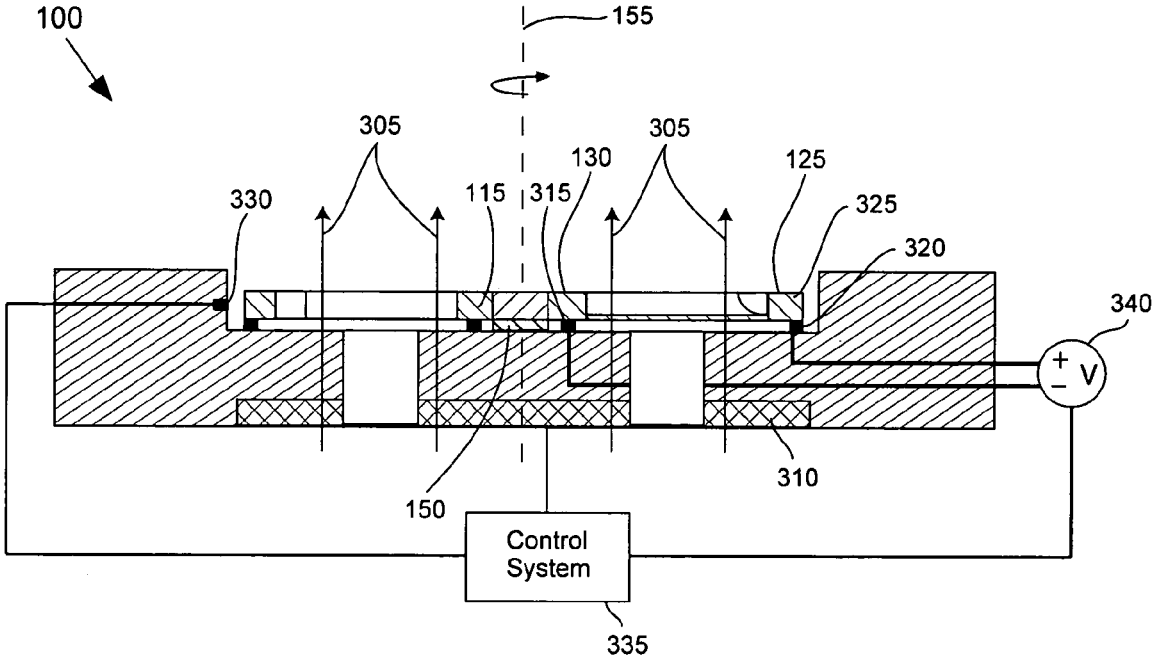
FIG. 3 is a section view of the fluid pump of FIG. 1 taken along section line 3-3.

Referring to FIG. 3, a cross section is shown of the fluid pump 100 of FIG. 1 taken along section line 3-3. The rotatable disk 115 is immersed in a magnetic field, illustrated with magnetic field lines 305, which are typically perpendicular to the surface 125 of the disk 115 and aligned with the axis of rotation 155 of the disk. One or more magnets 310 can be provided above and/or below the disk 115 to generate the magnetic field 305. The magnets 310 can include permanent magnets and/or electromagnets.

A first contact brush 315 can contact the disk 115 near its central portion 130, which is proximate to the disk central axis 155. A second contact brush 320, which can be radially spaced from the first contact brush 315 to contact the radial edge portion 325 of the disk 115. The second contact brush 320 can contact the radial edge portion 325 at a single point, or circumferentially extend under or around the entire radial edge portion 325.

In one arrangement, a contact brush (not shown) can be provided to contact the axle 150. Additional contact brushes also can be provided. For example, contact brushes can be spaced in a circular pattern to contact multiple points on the radial edge portion 325. Similarly, contact brushes can be spaced near the central portion 130 of the disk 115 to contact the central portion 130 at multiple points, to form a continuous circumferential contact surface at the central portion 130.

When voltage is applied across the contact brushes 315 and 320, causing current to flow through the disk 115, magnetic forces are exerted on the moving charges. The moving charges in turn exert the force to the disk 115, thereby causing the disk 115 to rotate. Notably, the direction of rotation depends on the direction of the current flow through the disk 115, for example, whether the current flows from the central portion 130 of the disk 115 to the radial edge portion 325, and vice versa. Accordingly, the polarity of the applied voltage can be changed when it is desired to change the direction of rotation of the conductive disk 115.

Further, a sensor 330 can be provided for monitoring the rotational speed of the disk 115. For instance, the sensor 330 can be operatively connected as part of a closed loop control system 335 which controls the rotational speed of the disk 115. The sensor 330 can communicate rotational data to control circuitry in the control system 335. Such sensors are known to the skilled artisan. For example, the sensor can be an optical sensor which reads one or more marks on the disk 115 as the disk 115 rotates. In another arrangement, the sensor can generate a signal each time an impeller passes the sensor as the disk rotates. The time period between sequential mark readings (or impellers passing the sensor) can be measured and correlated to the rotational speed of the disk 115.

In another arrangement, the sensor 330 can monitor a volume of fluid flow through the fluid pump and communicate fluid flow data to the control circuitry in the control system 335. The control system 335 can control the rotational speed of the disk 115 as required to achieve or maintain a desired volume of fluid flow. Still, there are a myriad of other sensors known to the skilled artisan that can be used to measure or derive the rotational speed of the disk or fluid flow volume, and the invention is not so limited.

Regardless of how rotational speed is determined, the control system 335 can control the rotational speed of the disk 115 by controlling a voltage and/or current source 340 that applies voltage to the disk 115. The control system 335 also can control the rotational speed by controlling the field strength 305 of the magnets 310. For instance, in the case that the magnet 310 comprises an electromagnet, electric current through the electromagnet can be adjusted.

Figure 4A:
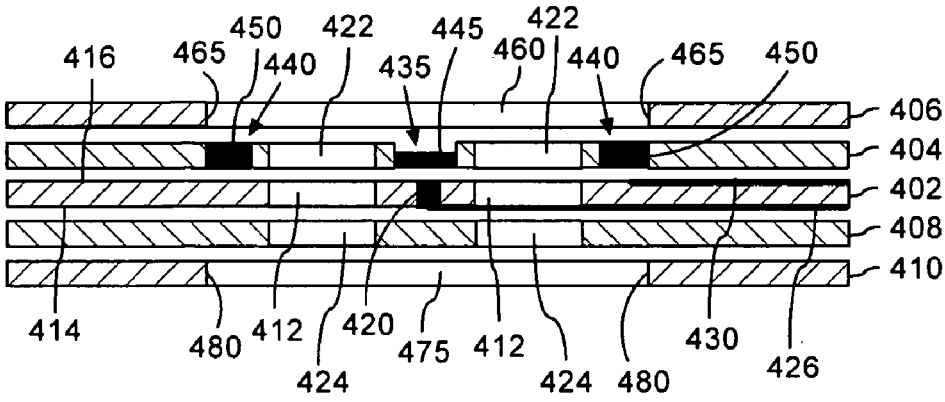
FIGS. 4A-4C illustrate a process for manufacturing the fluid pump on a dielectric substrate, which is useful for understanding the present invention.
Figure 4B:
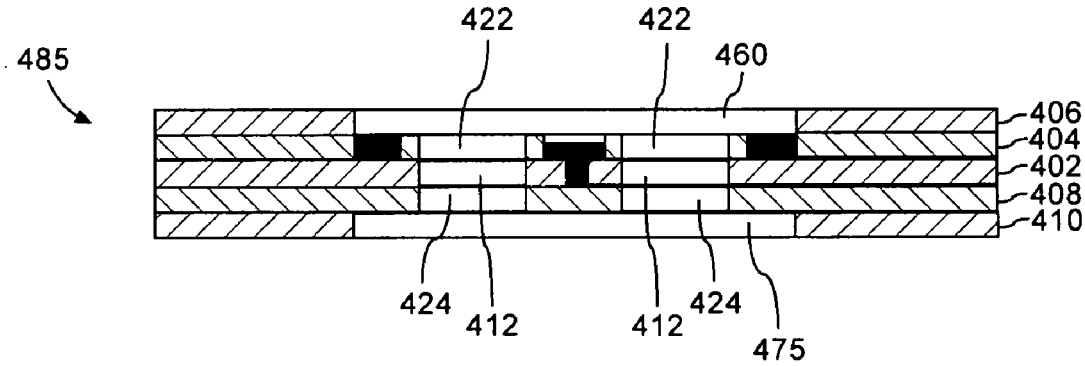
Figure 4C:
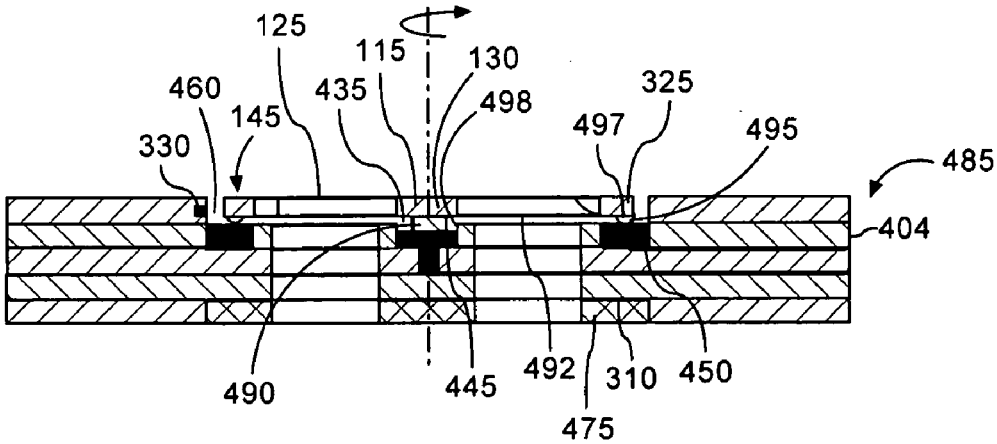

FIGS. 4A-4C represent one manufacturing process that can be used for manufacturing the fluid pump of FIG. 1 on a ceramic substrate. Nevertheless, it should be noted that the structures represented in FIGS. 4A-4C also can be implemented for manufacturing the fluid pump with other types of substrates, for example with LCP substrates. It should be noted, however, that the lamination and curing processes can differ for each type of substrate, as would be known to the skilled artisan.

One LCP substrate that can be used is R/flex® 3000 Series LCP Circuit Material available from Rogers Corporation of Rogers, Conn. The R/flex® 3000 LCP has a low loss tangent and low moisture absorption, and maintains stable electrical, mechanical and dimensional properties. The R/flex® 3000 LCP is available in a standard thickness of 50 μm, but can be provided in other thicknesses as well.

One ceramic substrate that can be used is low temperature 951 co-fire Green Tape™ from Dupont®. The 951 co-fire Green Tape™ is Au and Ag compatible, and has acceptable mechanical properties with regard to thermal coefficient of expansion (TCE) and relative strength. It is available in thicknesses ranging from 114 μm to 354 μm. Other similar types of systems include a material known as CT2000 from W. C. Heraeus GmbH, and A 6S type LTCC from Ferro Electronic Materials of Vista, Calif. Any of these materials, as well as a variety of other LTCC materials with varying electrical properties can be used.

Referring to FIG. 4A, a first substrate layer 402 can be provided. The substrate material that is to be used in each of the substrate layers can be preconditioned before being used in a fabrication process. For example, if the substrate is ceramic, the ceramic material can be baked at an appropriate temperature for a specified period of time or left to stand in a nitrogen dry box for a specified period of time. Common preconditioning cycles are 160° C. for 20-30 minutes or 24 hours in a nitrogen dry box. Both preconditioning process are well known in the art of ceramic substrates.

Once the first substrate layer 402 is preconditioned, fluid channels 412 can be formed in the first substrate layer 402 for carrying fluid through the fluid pump. The fluid channel 412 can extend from a bottom surface 414 of the first substrate layer 402 to an upper surface 416 of the substrate layer 402. Many techniques are available for forming the channels 412 in a substrate. For example, the channels can be formed by mechanically punching holes or laser cutting holes into the substrate.

A conductive via 420 also can be formed in the first substrate layer 402 to provide electrical conductivity through the substrate layer. Many techniques also are available for forming conductive vias in a substrate, for instance by mechanically punching holes or laser cutting holes into the substrate. The holes then can be filled with a conductive material, such as a conventional thick film screen printer or extrusion via filler. Vacuum can be applied to the first substrate layer 402 through a porous stone to aid via filling. Once the conductive via 420 has been formed in the first substrate layer 402, the conductive material can be dried in a box oven at an appropriate temperature and for an appropriate amount of time. For example, a common drying process is to bake the ceramic substrate having the conductive material at 160° C. for 5 minutes.

After the conductive filler in the via has dried, a first conductive circuit trace 426 and a second conductive circuit trace 430 can be provided. The circuit traces 426, 430 can be deposited onto the first substrate layer 402 using a conventional thick film screen printer, for example, standard emulsion thick film screens. In one arrangement, the circuit traces 426, 430 can be deposited onto opposite sides of the first substrate layer 402, with the first circuit trace 426 being in electrical contact with the conductive via 420. The second circuit trace 430 can extend around, and be concentric with, the conductive via 420. Nonetheless, a myriad of other circuit layouts can be provided, as would be known to the skilled artisan. As with the via filling process, once the circuit traces have been applied to the first substrate layer 402, the circuit traces can be dried in a box oven at an appropriate temperature and for an appropriate amount of time.

Subsequent substrate layers can be laminated to the first substrate layer 402 after appropriate preconditioning and drying of the circuit traces and/or via fillers. In particular, a second substrate layer 404 can be stacked onto the first substrate layer 402. The second layer 404 can insulate circuit traces on the top of the first substrate layer 402. The second substrate layer also can include fluid channels 422 and vias 435, 440. The vias 435, 440 can be filled with material to form an axial contact brush 445 and at least one radial contact brush 450, respectively. The vias 435, 440 can be positioned so that the contact brushes are electrically continuous with respective circuit traces 426, 430. In one arrangement, a plurality of radial contact brushes 450 or a continuous radial edge contact brush can be disposed concentric with, and at a uniform radius from, the axial contact brush 445 to reduce a net contact resistance between the a conductive object and the brushes.

The contact brushes can include any conductive material suitable for use in a contact brush, for example a conductive epoxy, conductive polymer, carbon nano composite or a conductive liquid. In the case that the contact brushes are a solid material, such as carbon nano composite, the contact brushes can be screen printed into the vias in the second substrate layer 404 using a conventional thick film screen printer. In the case that a conductive liquid is used as contact brushes, ferromagnetic properties can be incorporated into the conductive liquid so that a magnetic field can contain the conductive liquid within the vias 435, 440. Alternatively, surface tension can be used to keep the conductive fluid within the vias. In one arrangement, the axial contact brush 445 can fill only part of the via 435 so that a top surface of the contact brush 445 is disposed below the upper surface 416 of the second substrate layer 404. Accordingly, the via 435 also can function as a bearing.

A third substrate layer 406 can be stacked above the second substrate layer 404. The third substrate layer 406 can incorporate an aperture 460 having a radius edge 465 aligned with an outer radius of vias 450 (a portion of each via furthest from the via 435). A fourth substrate layer 408 can be stacked below the first substrate layer 402 to insulate circuit traces on the lower surface 414 of the first substrate layer 402. Additionally, fluid channels 424 can be formed through the fourth substrate layer 408. Further, a fifth substrate layer 410 can be stacked below the fourth substrate layer 408. The fifth substrate layer 410 also can include an aperture 475 having an outer radius 480.

In some instances it can also be desirable to include a conductive ground plane (not shown) on at least one side of one or more of the substrate layers 402, 404, 406, 408, 410. For example, the ground plane can be used in those instances where RF circuitry is formed on the surface of a substrate layer. The conductive ground plane also can be used for shielding components from exposure to RF and for a wide variety of other purposes. The conductive metal ground plane can be formed of a conductive metal that is compatible with the substrate. Still, those skilled in the art will appreciate that the ground plane is not required for the purposes of the invention.

Referring to FIG. 4B, the first five layers 402, 404, 406, 408, 410 can be stacked to form a substrate structure 485. Respective ones of fluid channels 412, 422, 424 can be aligned to provide continuous fluid flow paths from the aperture 475 to the aperture 460. Importantly, it should be noted that the fluid channel and layer schemes presented herein are by example only. Notably, other fluid channel configurations can be provided. Moreover, a greater number or a fewer number of substrate layers also can be used. Notably, each of the substrate layers can further comprise multiple sub layers which have been stacked to form each layer.

Once the substrate layers have been stacked to form the substrate structure 485, the structure 485 can be laminated using a variety of lamination methods. In one method, the substrate layers can be stacked and hydraulically pressed with heated platens. For example, a uniaxial lamination method presses the substrate layers together at 3000 psi for 10 minutes using plates heated to 70° C. The substrate layers can be rotated 165° following the first 5 minutes. In an isotatic lamination process, the substrate layers are vacuum sealed in a plastic bag and then pressed using heated water. The time, temperature and pressure can be the same as those used in the uniaxial lamination process; however, rotation after 5 minutes is not required. Once laminated, the structure 485 can be fired inside a kiln on a flat tile. For example, the substrate layers can be baked between 200° C. and 500° C. for one hour and a peak temperature between 850° and 875° can be applied for greater than 15 minutes. After the firing process, post fire operations can be performed on the substrate layers.

Referring to FIG. 4C, the disk 115 can be provided within the cavity 145, formed by aperture 460. The disk 115 can comprise a conductive material, such as aluminum, copper, brass, silver, gold, steel, stainless steel, or any other rigid conductive material. In another arrangement, the disk 115 can comprise a plurality of materials, for example a semi-rigid conductive material that is laminated to a rigid material, for instance ceramic. The disk 115 can include a central contact 490 axially located on the lower surface 492, and at least one radial contact 495, also located on the lower surface 492. In one arrangement, the radial contact 495 can extend around the lower peripheral region 497 of the disk 115. The disk 115 can be positioned above the second substrate layer 404 so that the central contact 490 makes electrical contact with the axial contact brush 445 and the radial contact 495 makes electrical contact with the radial edge contact brush 450. Accordingly, electrical current can flow between the central portion 130 of the disk and radial edge portion 325 when voltage is applied across the contact brushes 445, 450. A radial wall 498 of the via 435 can function as a bearing surface for the central contact 490 of the disk 115. Alternatively, bearings (not shown) can be installed between the radial wall 498 and the central contact 490. The bearings can be, for example, electromagnetic or electrostatic bearings.

As noted, a sensor 330 can be provided for use in a control circuit for controlling operation of the disk 115. The sensor 330 can be disposed in any location suitable for measuring rotational speed of the disk 115. Circuit traces can be provided as required for propagating sensor data, as would be known to the skilled artisan.

One or more magnets can be fixed above and/or below the disk 115 to provide the magnetic field aligned with an axis of rotation of the disk 115. For example, a magnet 310 can be attached to the bottom of the substrate structure 485, for example in the aperture 475, such that the magnet 310 is spaced from the lower surface 492 of the disk 115. Nonetheless, the invention is not limited in this regard. For instance, a magnet 310 also can be spaced from the upper surface 125 of the disk 115. The magnet 310 can be a permanent magnet, such as a magnet formed of magnetic material. For example, the magnet 310 can be made of ferrite, neodymium, alnico, ceramic, and/or any other material that can be used to generate a magnetic field.

The magnet 310 also can be a non-permanent magnet, for example, an electromagnet. In another arrangement, the magnet can be a combination of one or more permanent magnets and one or more non-permanent magnets, for example, an electromagnet adjacent to one or more layers of magnetic material. As previously noted, the strength of the magnetic field generated by an electromagnet can be varied by varying the current through the conductor of the electromagnet, which can provide an additional means for controlling the amount of rotation of the disk 115.

In another exemplary embodiment, the fluid pump 100 can be manufactured on a semiconductor substrate, for example on a silicon substrate using a polysilicon microfabrication process. Polysilicon microfabrication is well known in the art of micromachining. One such process is disclosed in David A. Koester et al., *MUMPs Design Handbook* (Rev. 7.0, 2001). An exemplary polysilicon microfabrication process is shown in FIGS. 5A-5H. It should be noted, however, that the invention is not limited to the process disclosed herein and that other semiconductor microfabrication processes can be used.

Figure 5A:
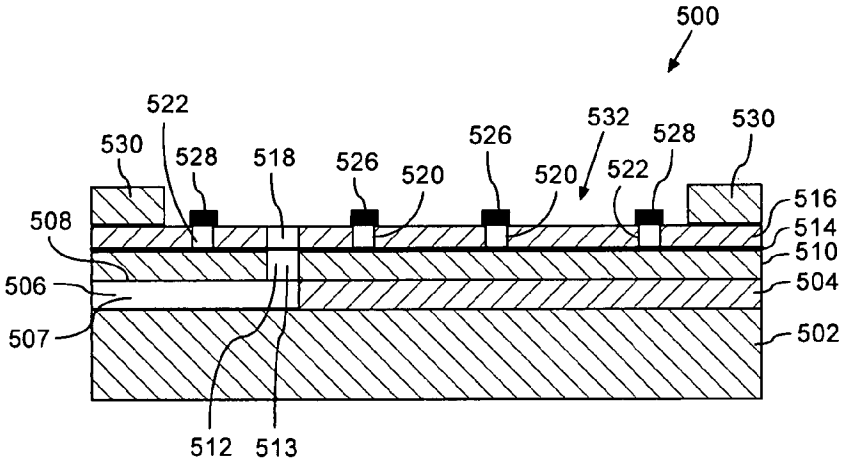
FIGS. 5A-5H illustrate a process for manufacturing the fluid pump on a semiconductor substrate, which is useful for understanding the present invention.

Referring to FIG. 5A, a first structural xlayer of polysilicon (poly 1 layer) 504 can be deposited onto the first silicon layer 502 using low pressure chemical vapor deposition (LPCVD). The poly 1 layer 504 then can be etched to form a first channel portion 506. In an alternate arrangement, the first channel portion 506 region can be masked prior to application of the poly 1 layer 504, thereby preventing deposition in the first channel portion 506 region.

After the first channel portion 506 has been formed, it can be filled with a sacrificial material 507, for example silicon dioxide ($SiO_2$) or phosphosilicate glass (PSG). The sacrificial material 507 can be removed at the end of the process, as is further discussed below. The sacrificial material 507 can be deposited by LPCVD and annealed to the circuit. For example, in the case that PSG is used for the sacrificial material 507, the sacrificial material can be annealed at 1150° C. in argon. The sacrificial material then can be planarized within the channel 506 using a planarizing etch-back process to form a flat base 508 upon which a second polysilicon layer (poly 2 layer) 510 can be deposited.

The second structural layer of polysilicon (poly 2 layer) 510 can be deposited onto the poly 1 layer 504 using LPCVD. The poly 2 layer 510 then can be etched to form a second channel portion 512. Alternatively, the second channel region 512 can be masked prior to application of the poly 2 layer 510, thereby preventing deposition in the second channel portion 512. The second channel portion 512 can be filled with a sacrificial material 513. Again, the sacrificial material 513 can be removed at the end of the process.

A conductive layer, for example a layer of doped polysilicon or aluminum, can be deposited onto the poly 2 layer 510. After deposition of the conductive layer, conductive circuit traces 514 can be defined using known lithography and etching techniques. After the circuit traces are formed, an electrically insulating layer 516, such as silicon nitride (SiN), can be deposited over the poly 2 layer 510 and the circuit traces 514. For example, LPCVD involving a reaction of dichlorosilane ($SiH_2Cl_2$) and ammonia ($NH_3$) can be used to deposit an insulating layer. A typical thickness for the SiN layer is approximately 600 nm, but other thicknesses can be used.

A third channel portion 518, inner vias 520 and outer vias 522 then can be formed through the insulating layer 516. The inner vias 520 and outer vias 522 can be filled with electrically conductive material (e.g. aluminum) to electrically contact the circuit traces 514 at desired locations. Axial contact brushes 526 then can be deposited on inner vias 520 and radial edge contact brushes 528 can be deposited on outer vias 522 so that the contact brushes 526 and 528 are electrically continuous with the respective vias 520 and 522 and correlating circuit traces 514. Two axial contact brushes 526 and two radial edge contact brushes 528 are shown in the figure, but additional axial and radial edge contact brushes can be provided. Further, the contact brushes can include any conductive material suitable for use in a contact brush, for example, a carbon nano composite which can be applied using a thermo spray method commonly known to the skilled artisan. In another arrangement, the contact brushes can be a conductive liquid.

A third structural layer of polysilicon (poly 3 layer) 530 can be deposited onto the insulating layer 516 using LPCVD. The poly 3 layer 530 then can be etched to form a radial aperture 532, which exposes the contact brushes 526 and 528. In an alternate arrangement, the aperture 532 region can be masked prior to application of the poly 3 layer 530, thereby preventing deposition in the aperture 532 region.

Figure 5B:
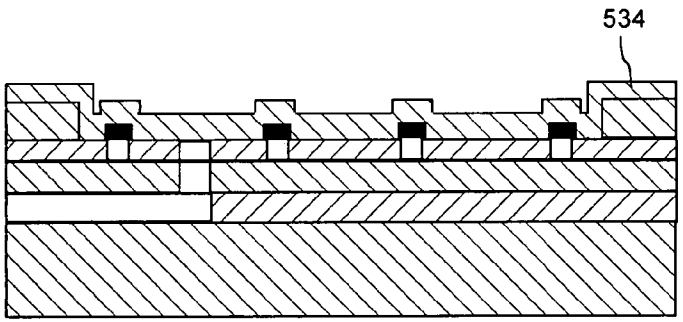
Figure 5C:
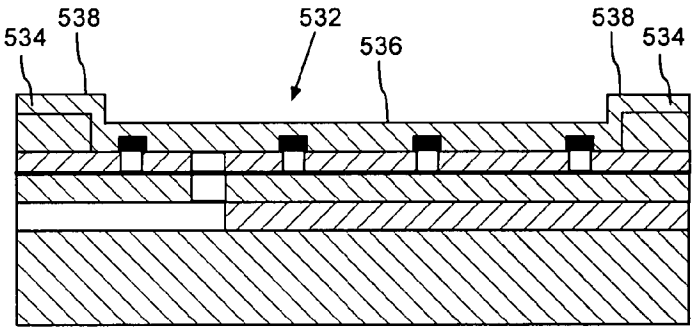

Referring to FIG. 5B, a first sacrificial layer 534, for example silicon dioxide ($SiO_2$) or phosphosilicate glass (PSG), can be applied to the substrate over the previously applied layers. The first sacrificial layer 534 can be removed at the end of the process. The sacrificial layer can be deposited by LPCVD and annealed to the circuit. Referring to FIG. 5C, the first sacrificial layer 534 then can be planarized within the aperture 532 using a planarizing etch-back process to form a flat base 536 within the aperture 532 that is recessed from an upper elevation 538 of the first sacrificial layer 534.

Figure 5D:
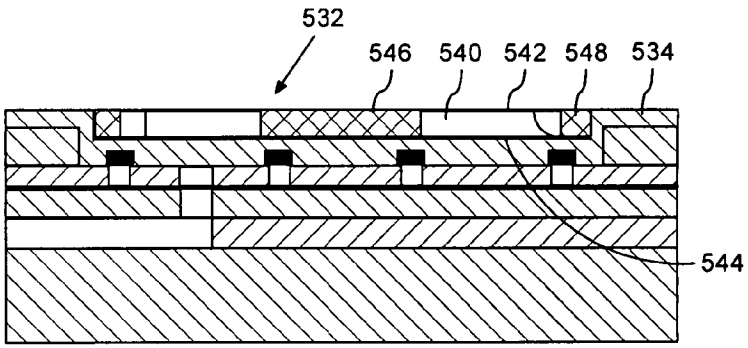

Referring to FIG. 5D, a conductor then can be deposited into the aperture 532 to form a disk (disk) 540 having opposing upper surface 542, a lower surface 544, an axial portion 546, and a radial edge portion 548. Further, the disk 540 can be wholly contained within the aperture 532 so that the only material contacting the disk 540 is the first sacrificial layer 534. The thickness of the disk 540 can be determined by the thickness of the first sacrificial layer 534 and the amount of etch-back. Importantly, mechanical characteristics, such as rigidity, should be considered when selecting a thickness for the disk 540.

Figure 5E:
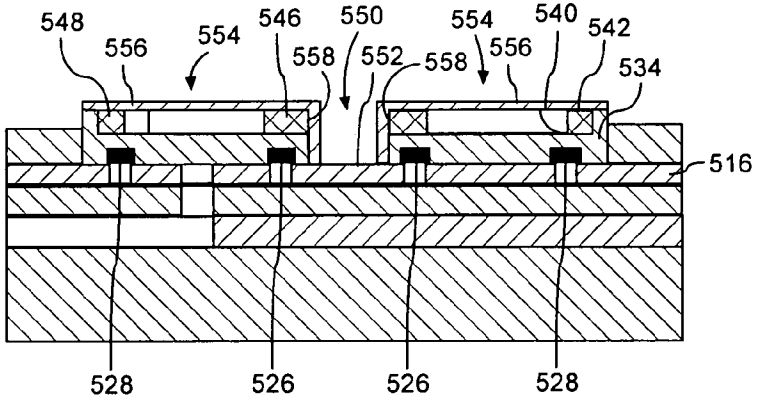

Referring to FIG. 5E, a first orifice 550 then can be etched through the inner region of the disk 540 and through the first sacrificial layer 534 below the center of the disk 540 to expose the insulating layer 516. Notably, the first orifice 550 can be sized to form a hole in the disk 540 having a radius equal to or smaller than the radial distance between opposing axial contact brushes 526 and 528. Further, a portion of the first sacrificial layer 534 in contact with the insulating layer 516 also can be etched away to expose a region 552 of the insulating layer 516 below the first orifice 550. Additional orifices 554 can be etched through the disk 540 in regions of the disk 540 disposed between the axial portion 546 and the radial edge portion 548. Known etching techniques can be used, for example reactive ion etches (RIE), plasma etching, etc.

Figure 6:
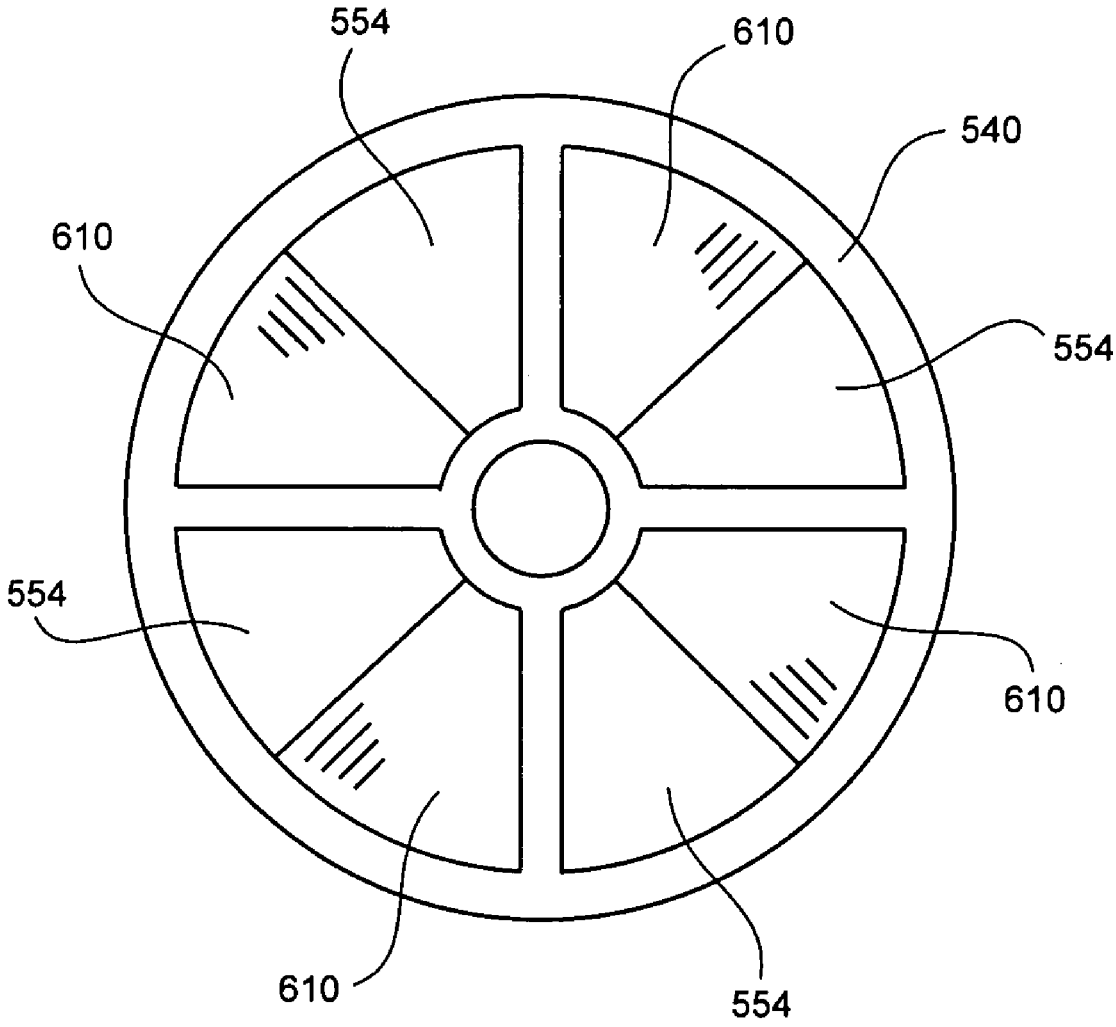
FIG. 6 is a top view of a disk which is a component in the fluid pump of FIG. 5.

A top view of the disk 540 is shown in FIG. 6. Portions 610 of the disk 540 immediately adjacent to the orifices 554 can be contoured to form impellers. For example, a laser micromachining process can be used to accurately ablate the surface of each portion 610 to varying depths to achieve desired impeller contours. Laser micromachining is known to the skilled artisan. Tools and process information for performing laser micromachining are available from Exitech Inc. of Foster City, Calif.

Referring again to FIG. 5E, a second sacrificial layer 556, for example $SiO_2$ or PSG, then can be applied over an upper surface 542 of the disk 540 and over the radial wall 558 formed by the first orifice 550. The region 552 of the insulating layer 516 should be masked during the application of the second sacrificial layer 556 to prevent the second sacrificial layer 556 from adhering to the insulating layer 516 in the region 552. Alternatively, a subsequent etching process can be performed to clear away the second sacrificial layer from the region 552.

Figure 5F:
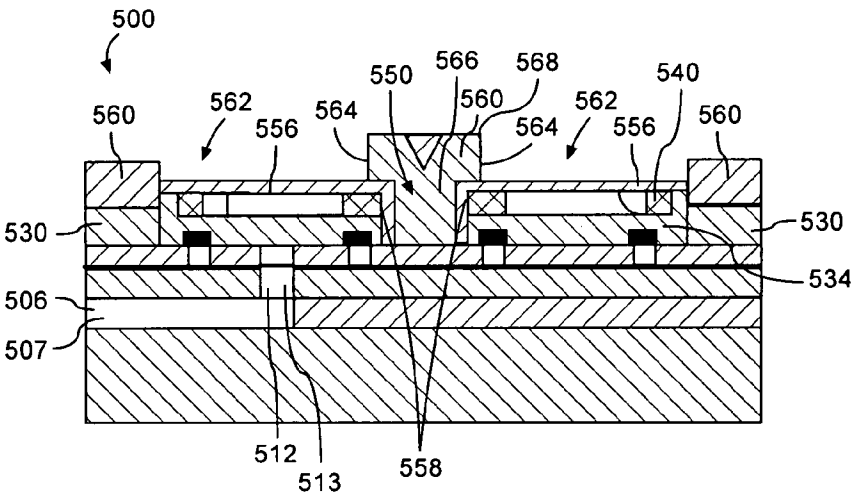

Referring to FIG. 5F, using LPCVD, a fourth layer of polysilcon (poly 4 layer) 560 can be deposited over the previously applied layers, for example over the poly 3 layer 530 surrounding the disk 540, thereby adding an additional silicon structure. Notably, the poly 4 layer 560 also can fill the orifice 550. A portion of the poly 4 layer 560 then can be etched to remove a washer shaped portion 562 of the poly 4 layer 560 located above the disk 540. Notably, the inner radius 564 of the washer shaped portion 562 can be larger than the inner radius of the disk 540. Accordingly, the etching of the poly 4 layer 560 can leave a structure 566, having a "T" shaped cross section, within the first orifice 550. An upper portion 568 of the structure 566 can extend over the inner portion 558 of disk 540, thereby limiting vertical movement of the disk 540 once the sacrificial layers are removed. Further, the structure 566 can operate as a bearing around which the disk 540 can rotate. Alternatively, electromagnetic or electrostatic bearings can be provided in the first orifice 750.

The sacrificial material 507, 513 in the first and second channel regions 506, 512, respectively, and the first and second sacrificial layers 534, 556 then can be released from the fluid pump structure 500, for example using a hydrogen fluoride (HF) solution. Such a process is known to the skilled artisan. For example, the fluid pump structure 500 can be dipped in an HF bath. HF does not attack silicon or polysilicon, but quickly etches $SiO_2$. Notably, the HF can etch deposited $SiO_2$ approximately 100× faster than SiN.

Figure 5G:
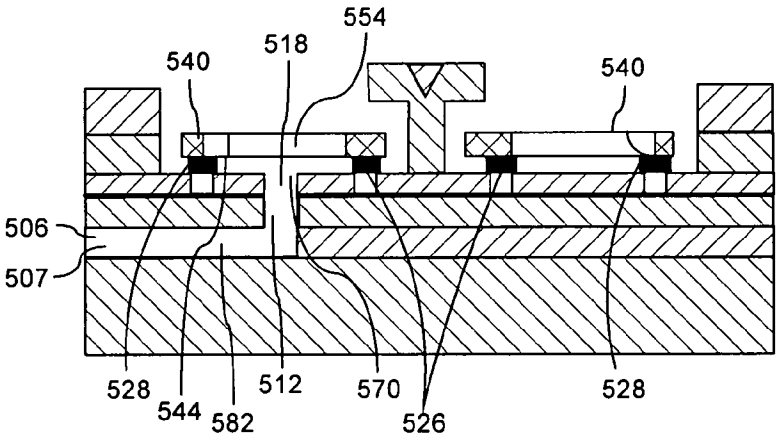

Referring to FIG. 5G, the release of the sacrificial material and sacrificial layers clears the first, second and third channel portions 506, 512, 518 to form a fluid channel 582. In operation, fluid can flow through the fluid channel, through a first fluid flow port 570, and through the second orifice 554 within the disk 540. The release of the sacrificial layers also enables the disk 540 to rest upon, and make electrical contact with, the axial and radial edge contact brushes 526 and 528. The disk 540 then can be free to rotate about its axis and can be used to pump fluid through the first fluid flow port 570.

Figure 5H:
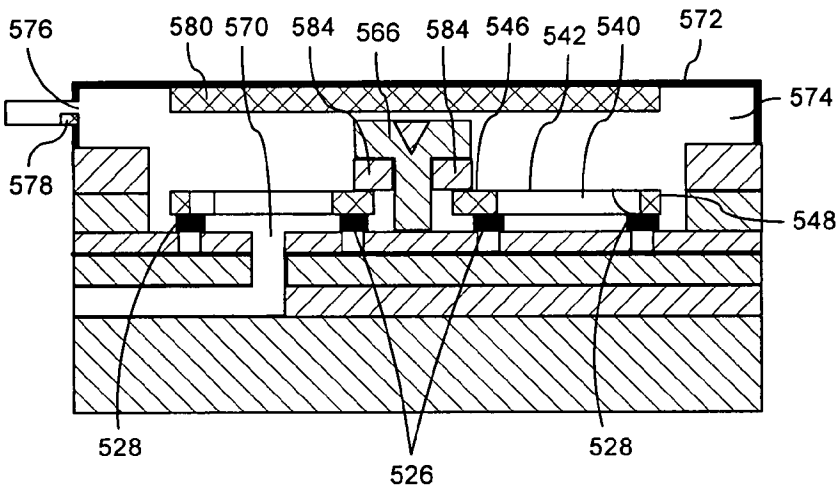

A lid 572 can be provided above the disk 540 to provide an enclosed region 574 in which the disk 540 can rotate, as shown in FIG. 5H. A second fluid flow port 576 can be provided in the lid 572 and fluidically coupled to the first fluid flow port 570. However, the invention is not limited in this regard. For example, the second fluid flow port can be positioned to allow fluid flow through a second fluid channel within one or more of the substrate layers. Further, a sensor 578 also can be provided. For example, in the case that the sensor 578 is a fluid flow sensor, the sensor 578 can be located proximate to the second fluid flow port 576, as shown, or proximate to the first fluid flow port 570. Still, as previously noted, other types of sensors can be implemented. Circuit traces can be provided as required for propagating sensor data, as would be known to the skilled artisan.

A magnet 580 can be fixed above and/or below the disk 540 to provide a magnetic field aligned with the axis of rotation of the disk 540. For example, the magnet 580 can be attached to the bottom of the lid 572, spaced from the upper surface 542 of the disk 540. Further, a magnet 580 can be attached to the bottom of the first silicon substrate below the disk 540, for example using additional substrate layer.

As previously noted, the magnet 580 can be a permanent magnet, non-permanent magnets, or a combination of a permanent magnet and a non-permanent magnet. For example, the magnet can include an electromagnet and one or more layers of magnetic material. The strength of the magnetic field generated by an electromagnet can be varied by varying the current through the conductor of the electromagnet, which can be useful for varying the output current of the control valve, also as previously noted. In operation, a voltage applied across axial contact brush 526 and radial edge contact brush 528 causes current to flow between the axial portion 546 and the radial edge portion 548 of the disk 540, thereby causing the disk to rotate, as previously described. A gasket 584 can be disposed between the T-shaped structure 566 and the disk 540 to maintain the position of the disk 540 in contact with contact brushes 526, 528. For example, the gasket 584 can comprise a photodefinable polymer, such as a benzocyclobutene-based polymer, polyimide or SU-8. Such polymers are commercially available. For instance, SU-8 is commercially available from MicroChem Inc. of Newton, Mass. 02164. In one arrangement, the gasket 584 can be attached to the lid 574 or magnet 580 and lightly pressed down over the structure 566 when assembled.

Figure 7:
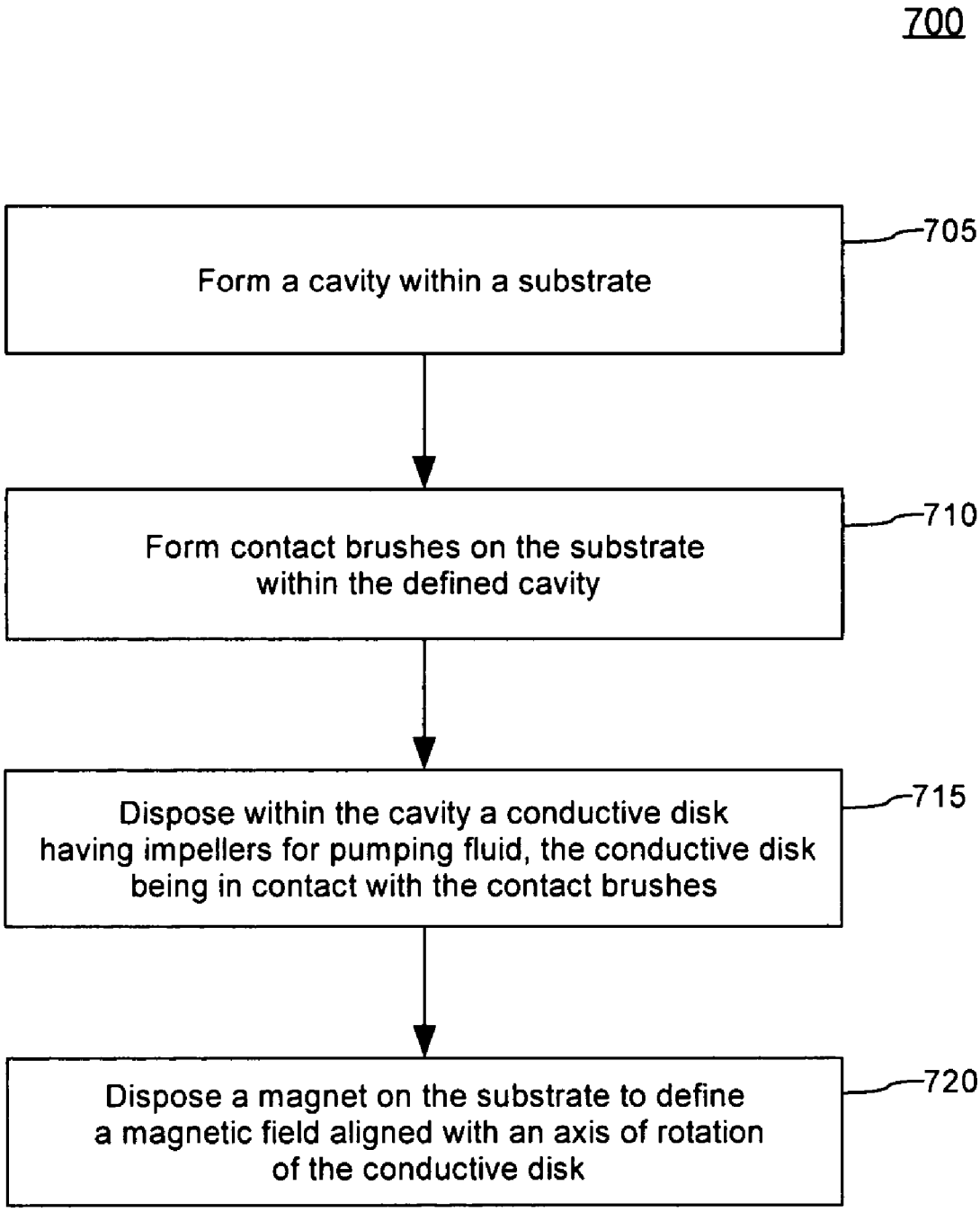
FIG. 7 is a flow chart that is useful for understanding the present invention.

A flow chart 700 which is useful for understanding the method of the present invention is shown in FIG. 7. Beginning at step 705, a cavity can be formed within the substrate. Proceeding to step 710, contact brushes can be formed on the substrate within the cavity. At least one contact brush can be disposed proximate to a central portion of the cavity and at least one contact brush can be disposed proximate to a radial edge portion of the cavity. Continuing at step 715, a conductive disk having an axial portion and a radial edge portion then can be disposed within the cavity to make electrical contact with the contact brushes. The conductive disk can include impellers disposed for pumping fluid. Referring to step 720, a magnet can be disposed on the substrate to define a magnetic field aligned with an axis of rotation of the conductive disk.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

The invention claimed is:

1. A fluid pump comprising:

a homopolar motor comprising a substrate having first and second opposing surfaces;

a rotatable disk comprised of a conductive material and disposed on a first surface of said substrate and having a central disk axis about which said rotatable disk can rotate;

a first contact brush electrically coupled to a central portion of said rotatable disk proximate to said central disk axis, and a second contact brush electrically coupled to a radial edge portion of said rotatable disk;

at least one magnet positioned proximate to said rotatable disk for producing a magnetic field passing through said rotatable disk and aligned with said central disk axis; and at least one impeller integrally formed within or on said rotatable disk;

wherein said conductive material extends from said radial edge portion to said central disk axis and provides a radial path for the flow of electric current between said first and second contact brushes.

2. The fluid pump of claim 1 wherein said rotatable disk is at least partially disposed within a cavity defined in said substrate.

3. The fluid pump of claim 1 wherein said substrate is selected from the group consisting of a ceramic substrate, a liquid crystal polymer substrate, and a semiconductor substrate.

4. The fluid pump of claim 1 said substrate having at least a first fluid port defined therein, said first fluid port fluidically coupled to said rotatable disk such that a movement of said rotatable disk causes a fluid to flow through said first fluid port.

5. The fluid pump of claim 4, said substrate having a second fluid port defined therein, said second fluid port fluidically coupled to said rotatable disk such that a movement of said rotatable disk causes a fluid to flow from said first fluid port through said second fluid port.

6. The fluid pump of claim 1, wherein a movement of said rotatable disk causes a fluid to flow in a direction that is substantially aligned with an axis of rotation of said rotatable disk.

7. The fluid pump of claim 1, wherein a rotation of said rotatable disk causes a fluid to flow generally tangential to an outer circumference of said rotatable disk.

8. The fluid pump of claim 1 further comprising a closed loop control circuit to control a rotational speed of a rotatable disk.

9. The fluid pump of claim 8 wherein said closed loop control circuit controls at least one of a voltage source and a current source that apply voltage across said rotatable disk.

10. The fluid pump of claim 8 wherein said closed loop control circuit controls a strength of said magnet that produces said magnetic field.

11. The fluid pump of claim 1 wherein said impeller comprises an orifice within said rotatable disk.

* * * * *